United States Patent [19]

Anderson

[11] 3,952,817

[45] Apr. 27, 1976

[54] BASKET TYPE CORE RETAINER

[75] Inventor: John Forrest Anderson, Minneapolis, Minn.

[73] Assignee: Longyear Company, Minneapolis, Minn.

[22] Filed: Mar. 8, 1974

[21] Appl. No.: 449,463

[52] U.S. Cl. ..... 175/240; 175/249

[51] Int. Cl.[2] ..... E21B 9/20

[58] Field of Search ..... 175/232, 236, 239–243, 175/249; 294/86.11

[56] References Cited

UNITED STATES PATENTS

| | | | |
|---|---|---|---|
| 314,777 | 3/1885 | Ball | 175/249 |
| 1,655,644 | 1/1928 | Baker | 175/240 |
| 1,720,877 | 7/1929 | Baker | 175/249 X |
| 1,761,292 | 6/1930 | Bone | 175/240 |
| 1,797,550 | 3/1931 | Hamaker | 175/249 |
| 2,083,062 | 6/1937 | Hampton | 175/240 X |
| 3,008,529 | 11/1961 | Lynch et al. | 175/243 |
| 3,807,234 | 4/1974 | Duperon | 175/249 X |
| 3,833,075 | 9/1974 | Bachman et al. | 175/243 X |

*Primary Examiner*—Ernest R. Purser
*Attorney, Agent, or Firm*—Dugger, Johnson & Westman

[57] ABSTRACT

Basket type core retainer apparatus that includes a core receiving tube having an axially inner end, an annular drill bit or tubular extension connected to the inner end of the core receiving tube and a core retainer cooperatively mounted by the tube and the bit or tubular extension to permit passage of core into the tube and retain a core or a soil sample in the tube. The core retainer includes a mounting ring that mounts a pair of spring finger assemblies to extend axially outwardly thereof. The finger assemblies are each formed from a single sheet of material, the fingers of the assemblies in a closed (core retaining) position having each finger of one assembly in partial overlapping relationship to an adjacent finger of the other assembly and in partial underlapping relationship to an adjacent finger of said other assembly. The fingers are movable to permit passage of a core or a soil sample into the receiving tube.

16 Claims, 7 Drawing Figures

BASKET TYPE CORE RETAINER

BACKGROUND OF THE INVENTION

A basket type core retainer for core barrels, soil sampler tubes and the like.

In the prior art it is old to provide a basket type core retainer for core barrels, for example, see U.S. Pat. No. 1,655,644 to Baker. Also, U.S. Pat. No. 3,008,529 to Lynch et al. discloses a core retainer having spring fingers. However, the Lynch structure has large gaps between the spring fingers and depends on a plastic bag dropping over the fingers to aid in retaining material in the core receiving tube. That is, there is insufficient overlapping of the fingers of Lynch to provide an as effective a closure and the degree of strength desired. In order to provide a stronger core retainer that provides a substantially complete closure in a core retaining position, and at the same time, a relatively inexpensive core retainer that may be easily manufactured, this invention has been made.

SUMMARY OF THE INVENTION

For a core barrel, soil sampler tube or the like, a core retainer that includes a mounting ring, and a pair of spring finger assemblies mounted by the mounting ring and having spring fingers extending axially outwardly and radially inwardly to form a closure but that are movable to permit passage of core therethrough in one direction.

One of the objects of this invention is to provide a new and novel core retainer having a pair of spring assemblies with the fingers of one assembly partially interleaved with the fingers of the other assembly. In furtherance of the above object, it is another object of this invention to provide spring fingers that are at least partially circumferentially overlapped even when the fingers extend substantially straight axially outwardly of the ring.

BRIEF DESCRIPTION OF THE DRAWINGS

Referring to FIG. 1 there is illustrated the axially inner (lower) portion of a core tube 11 for receiving a core or soil sample that has an annular bit or terminal end fitting 12 threaded thereon. The fitting or bit used will depend on the type of earth (hard, soft, etc.) that is being sampled and whether or not the tube is or is not a part of a wire line core assembly, and if it is, then the tube 11 would be the core receiving inner tube that is located in a core barrel assembly outer tube. The inner tube 11 has a recess 13 in which the mounting ring 14 of the core retainer, generally designated A, is mounted to be held therein by the fitting 12 abutting thereagainst at the threaded joint with the tube 11.

The core retainer also includes a radially outer finger assembly, generally designated 15, that has the circumferentially extending, continuous, axially lower edge (band) portion 16 welded or otherwise fixedly secured to the inner circumferential wall of the mounting ring. The circumference of the outer finger assembly lower edge portion is nearly as great as that of the circumference of the inner wall of the ring. When mounted in the ring, the axially extending terminal edges 17 and 18 (see Figure 7) of the lower edge portion 16 may be slightly spaced or abutting.

Figure 7:
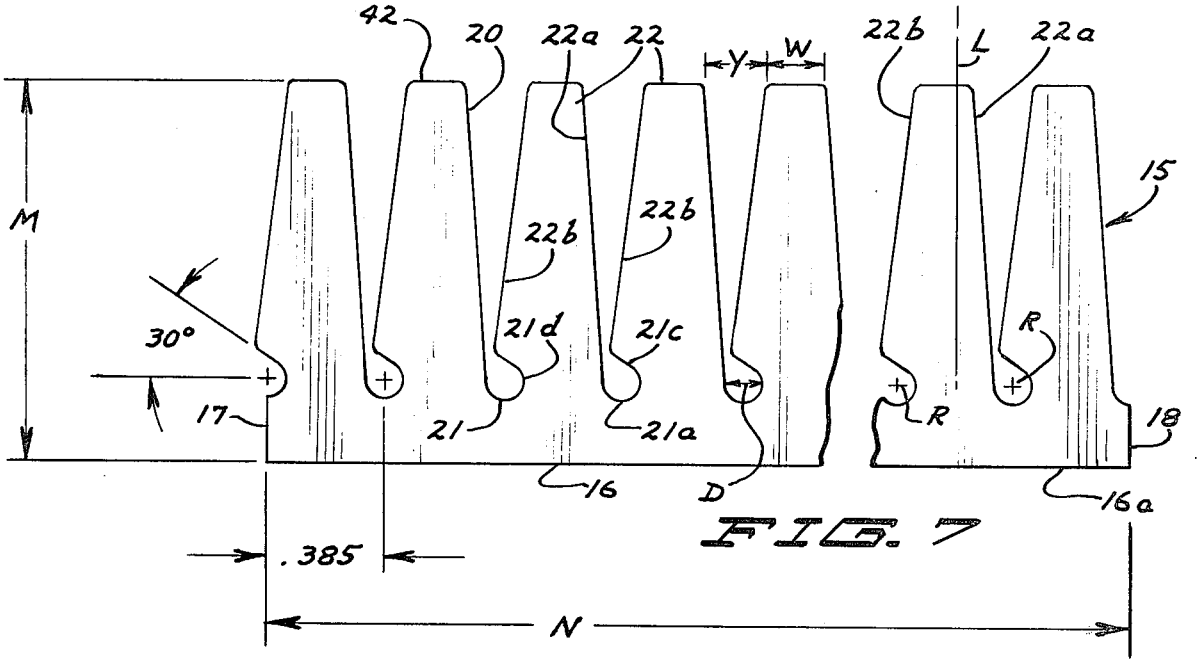
FIG. 7 is a developed view of the radially outer finger assembly.

Considering the outer ring assembly 15 in a flat condition as illustrated in FIG. 7, it is provided with a plurality of generally isosceles trapezoidial cutouts 20, each having a major base axially remote from edge portion 16 and a minor base that opens directly to the narrowed end of a generally teardrop shaped cutout 21 that is inclined downwardly and toward axial edge 18 of the lower edge portion 16 to provide a plurality of axially elongated fingers 22 that at their axially lower ends are integrally joined to the lower end portion 16 and upper edges that are of a smaller width W than their lower ends between cutouts 21. Thus each finger has a predominantly axially extending straight edge **22*a*, and a predominantly axially extending opposite straight edge 22*b* that is circumferentially spaced from edge 22*a***.

The lower part of each cutout 21 has a circumferentially curved edge **21*a* that has a diameter D parallel to the top (axially outer) edge 42 of the fingers and the bottom edge 16a of portion 16, and is curved about point R of the respective cutout. Each edge 21 intersects a straight line continuation of edge 22*a* formed by the trapezoidal cutout to form a smooth continuation thereof. Forming a smooth line continuation of edge 21*a* at a location opposite edge 22*a* and intersecting edge 22*b* to form an included obtuse angle therewith is a straight line edge 21*c* of the respective cutout 21, edge 21*a* extending through an arcuate angle of greater than 180°. Thus the lower part of each edge 22*b* terminates at a substantially higher elevation than point R and substantially to the left thereof for the respective cutout 20 as viewed in FIG. 7**.

The major base of each cutout 20 is a smaller length than the dimension W while the axial height of each finger is many times greater than the dimension W. The dimension W advantageously is greater than one-half that of the spacing between adjacent points R but substantially less than the spacing between said adjacent points.

Figure 6:
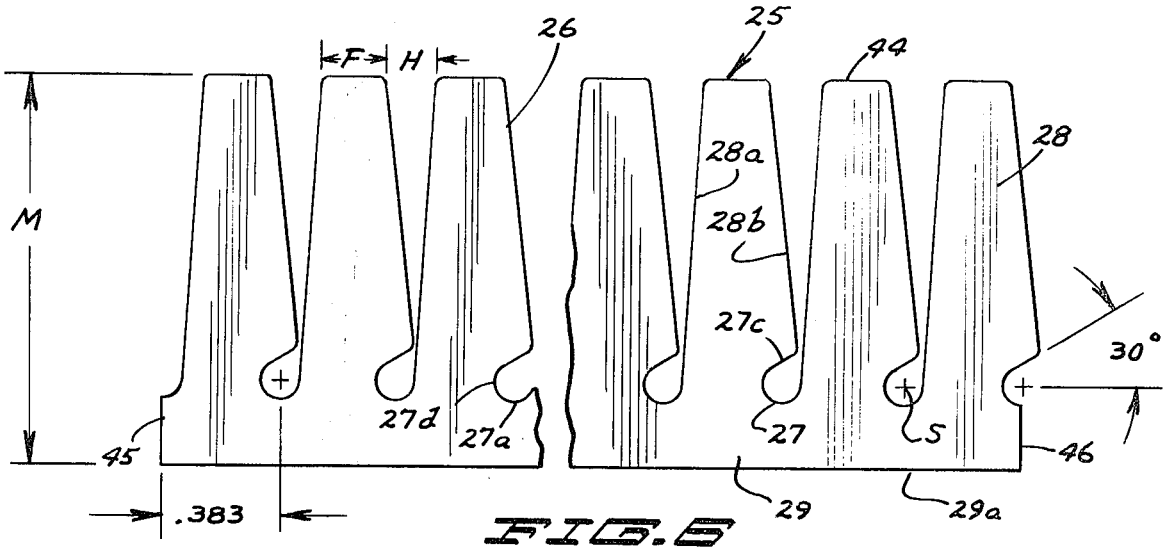
FIG. 6 is a developed view of the radially inner finger assembly.

The radially inner finger assembly, generally designated 25, (See FIG. 6), is one of the same construction as assembly 15 except the axial height and the circumferential length are slightly less than that of assembly 15. That is, assembly 25 has trapedzoidal cutouts 26, a teardrop cutout 27, a lower edge (band) portion 29 and fingers 28 having edges 28*a*, 28*b* provided by the cutouts. Cutouts 27 are of the same size and shape as cutouts 21; however, the spacing of the points S from adjacent points S for the arcuately lower edges 27*a* of cutouts 27 is slightly less than the spacing of points R.

Each of the spring finger assemblies is an integrally form unit that may be stamped from a single sheet of material, preferrably spring steel. As an example of assembling the core retainers, as viewed in FIGS. 6 and 7, the inner assembly 25 may be bodily lifted and positioned to have its remote surface abut against the surface of the outer assembly seen in FIG. 7. The fingers of one assembly are interleaved with the fingers of the other assembly and with the assemblies overlayed as above indicated, the assemblies 15, 25 are moved relative one another so that the cutouts 21, 27 have edges thereof adjacent points 21*d*, 27*d* crossing in the manner of an X. The lower edge portions 16, 29 are bent to form rings (or adjacent axial edges 17, 18 and 45, 46 respectively slightly spaced) with portion 29 radially inwardly of portion 16, edges 28*b* radially inwardly of fingers 22 and circumferentially intermediate edges 22*a*, 22*b* of the adjacent finger 22, while edges 22*a* are located radially inwardly of portions of fingers 28 and circumferentially intermediate edges 28*a*, 28*b* of the adjacent finger 28. Thus the axially extending edge portion 28*b* of each finger 28 is radially inwardly of the axially adjacent port of the axially extending edge portion 22*b* of each finger 22; and each axially extending edge portion 28*a* is radially outwardly of the axially adjacent part of the axially extending edge portion 22*a*.

The assembly of the fingers assemblies 15, 25 in the above manner is facilitated by the shape of the cutouts. That is, for example, for assembly 15, a line L perpendicular to the axially inner edge of lower (band) portion 16 and half way between adjacent points R of a finger intersects edge 42 of the finger and is located so that in any plane perpendicular to line L that intersects edges 22*a*, 22*b* of the finger, the point of intersection of the plane with edge 22*a* is substantially closer to line L than the point of intersection with edge 22*b*. Advantageously said point of intersection with edge 22*b* may be about twice as far from line L as the point of intersection with line 22*a*. The angles of divergence of edges 22*a*, 22*b* relative line L are equal, but opposite. The size and shape of each of the fingers 22 is the same, as is each of the fingers 28; however, the size of each of the fingers 28 is only slightly smaller than each of the fingers 22.

With the fingers interleaved in the above manner, the circumferential length F of each axial outer edge 44 of each finger 28 is greater than the gap Y between each of the adjacent pair of edges 42 (with the possible exception of the fingers of assembly 15 contiguous to edges 17, 18); and the circumferential length W of each axial outer edge 42 of each finger 22 is greater than the gap H between each of the adjacent pair of edges 44 (with the possible exception of fingers of assembly 25 contiguous to axially extending edges 45, 46 of band 29). Further with fingers interleaved, all or substantially all of each edge 21*c* is located radially inwardly of the radially adjacent part of a finger 28, and each edge 27*c* that corresponds to edge 21*c* is located radially outwardly of the radially adjacent part of a finger 22, both in a core retainer closed position and when a core sample is being taken and is passing through the core retainer.

Figure 1:
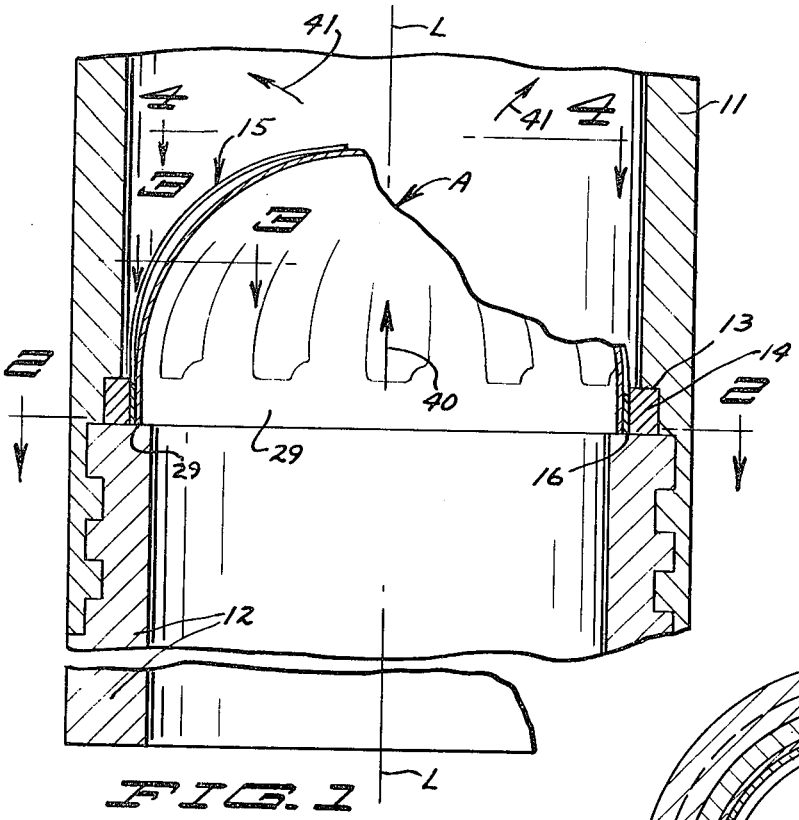
FIG. 1 is a fragmentary longitudinal cross-sectional view of a core barrel or soil sampler tube having the core retainer of this invention mounted therein, parts of the retainer being broken away, and the retainer being illustrated in a closed position.
Figure 3:
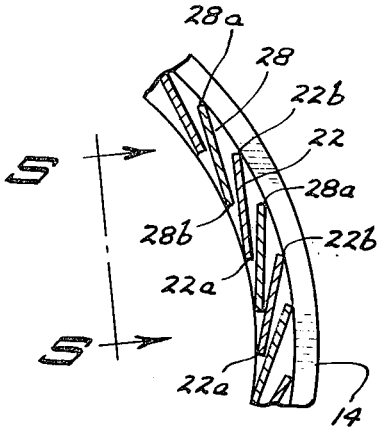
FIG. 3 is a somewhat simplified fragmentary transverse cross-sectional view of the core retainer that is generally taken along the line and in the direction of the arrows 3—3 of FIG. 2 to indicate the interleaving of the spring fingers of the spring assemblies, the relative thickness of the fingers being exaggerated.
Figure 2:
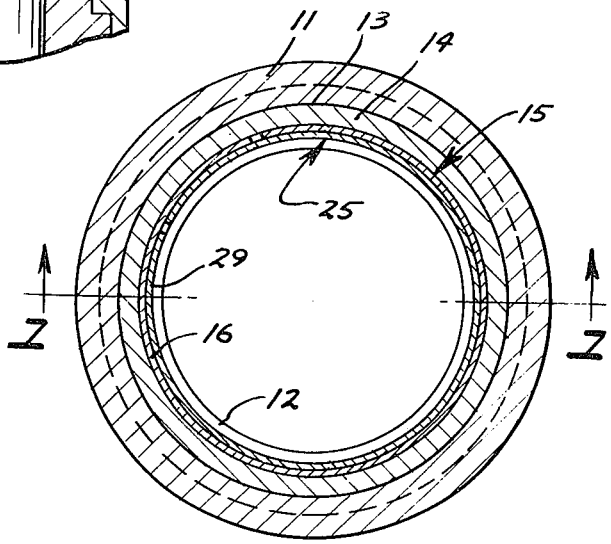
FIG. 2 is a transverse cross-sectional view generally taken along the line and in the direction of the arrows 2—2 of FIG. 1.
Figure 4:
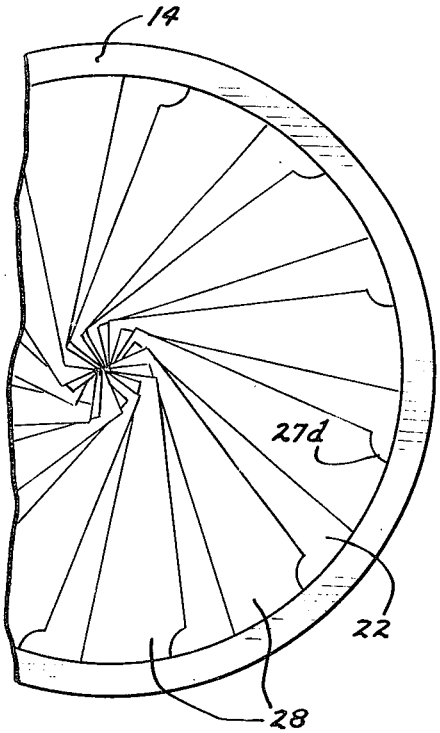
FIG. 4 is a plan view of the core retainer that is generally taken along the line and in the direction of the arrows 4—4 of FIG. 1.
Figure 5:
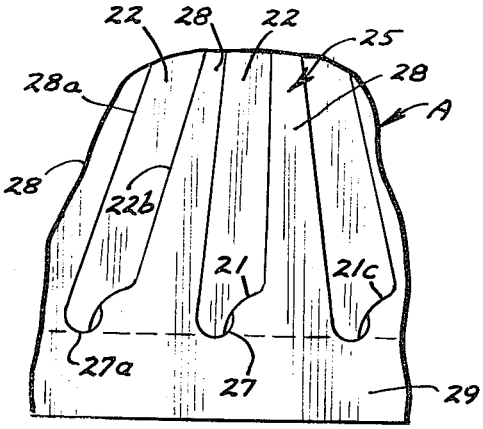
FIG. 5 is an enlarged, fragmentary, vertical elevational view of the core retainer that is generally taken along the line and in the direction of the arrows 5—5 of FIG. 3 to further illustrate the interleaving of the spring fingers.

The spring finger assemblies are secured to the mounting ring at the bands 16, 29 and have the axially outer ends arcuately bent to initially extend predominantly radially inwardly such as is in part indicated in FIG. 1, the fingers being heat treated to resiliently return to such a datum condition when moved away therefrom during use. That is, in the datum condition all of the axially outer terminal edges 42 of fingers 22, and corresponding edges 44 of fingers 28 extend closely adjacent the center axis L—L of the core receiving tube to provide a substantially complete or a complete closure. It is to be noted that each of the edges 42, 44 in part is axially inwardly of one of the adjacent fingers in one circumferential direction and in part axially outwardly of the adjacent finger in the other circumferential direction.

Assuming the exceptions referred to in the second above paragraph are not applicable, even when the fingers are bent upwardly and radially outwardly from their datum condition, the circumferentially outer edge portion of each finger including at the axially outer edge, in one circumferential direction exerts a force on the next circumferentially adjacent finger of the other assembly to resiliently urge it to its datum condition; and thus all the fingers when forced to bend axially and radially outwardly exert a force on one another tending to bend the fingers back to their datum condition. Of course, even if the above exception is applicable, the finger assemblies are mounted on the mounting ring so that each finger is in part radially outwardly of the adjacent finger of the other finger assembly in one circumferential direction and in part radially inwardly of the adjacent finger of the other assembly in the other circumferential direction, even when the fingers extend substantially entirely parallel to the central axis L—L of the ring 14.

In use, as the core tube or soil sampler tube 11 is driven into the earth, a core or soil sample is formed that extends progressively further into the tube (direction of arrow 40). As the top of the core abuts against the lower radially inner surfaces of the fingers 22, 28, the fingers axial outer ends are forced axially upwardly and radially outwardly (moved generally in the direction of arrow 41) against the resilient action of the fingers. After a sufficient axial length sample is in the tube, the tube is moved axially upwardly, and the edges 42, 44 of the fingers remote from the lower edge portions of the finger assemblies bit into and through the core to have the edges 42, 44 move toward the central longitudinal axis of the tube. As a result, the fingers move to a closed position to retain core thereabove. Since the fingers in a closed position overlap, at most only a small amount of material is lost even though the earth formation is loose gravel, sand or of a mucky nature. The closing action of any one finger is enhanced since a closing force is transmitted from all of the other fingers to the one finger; i.e., edge portion 28*a* of one finger resiliently urges the edge portion 22*a* of the second finger toward a closed position while edge portion 22*b* of the second finger urges edge portion 28*b* of a third finger toward a closed position and etc. This in part results from the fact that even when the fingers are bent by the core to extend substantially parallel to the central longitudinal axis of the tube 11, there is circumferential overlap of the fingers.

As an example of a core retainer of one size, and not otherwise as a limitation on the invention, each of the spring fingers assemblies may be made from a sheet of stainless stell of 0.004 inch thickness; the height M of assembly 15 about 1.5 inches and assembly 25 about 1 7/16 inches; the length N of assembly 15 about 4.62 inches and assembly 25 about 4.60 inches; the height of each point R above the axial inner terminal edge of the band portion inch; inche; the diameter of each edge 21*a* and corresponding edge of cutout 27, 7/64 inch; the spacing between adjacent points R 0.385 inch, and between adjacent points S 0.383 inch; the angle of inclination of edge 21*c* and corresponding edge of assembly 25 relative the axial inner edge (16*a*, 29*a*) of the respective band portion about 30°, the dimensions F and W each about 7/32 inch; the minor base of each cutout 20 and 26 about 1/32 inch; and each gap H and Y about 11/32 inch. Each assembly 15, 25 of the above dimensions has 12 fingers while the finger of each assembly from axially adjacent points R, S, to a location axially adjacent the axial outer end thereof is bent axially and radially inwardly to attempt to assume about a ⅝ inch radius. The axial thickness of the mounting ring 14 is preferrably slightly less than the minimum dimension from cutout 21 to the axial inner edge 16*a* of band 16.

What is claimed is:

1. For being mounted in the axially inner end portion of a core tube or a soil sampler tube, a core retainer mountable in said tube for retaining core in the tube axially outwardly thereof, said core retainer having a central axis and comprising a mounting ring and spring finger means mounted by the mounting ring for movement between a closed position for retaining core in said tube and an open position extending further axially away from the mounting ring than in the closed position to permit passage of a core therethrough, said spring means including a plurality a elongated fingers having one end portions axially adjacent the mounting ring that are at least partially interleaved, and opposite end portions that are at least partially interleaved in the spring means closed position, said spring means including a first spring finger assembly and a second spring finger assembly, each of the first and second assemblies respectively including a first plurality and a second plurality of said fingers and a first and a second band portion, the band portion of the first assembly being located radially outwardly of the band portion of the second assembly, the first fingers being joined to the first band portion to extend axially outwardly thereof and the second fingers being joined to the second band portion to extend axially outwardly thereof.

2. The apparatus of claim 1 further characterized in that each of the fingers has circumferentially spaced first and second edges extending at least the major portion of the length of the fingers, said edges diverging from one another in a direction along the length thereof in a direction toward the respective band portion.

3. The apparatus of claim 1 further characterized in that each finger of the second assembly is in part located radially inwardly of the adjacent finger of the first assembly in one circumferential direction relative the mounting ring and in part radially outwardly of the adjacent finger of the first assembly in the opposite circumferential direction.

4. The apparatus of claim 1 further characterized that in a closed position, the end portions of each finger remote from the mounting ring is in part axially inwardly of one finger of the other assembly and in part axially outwardly of another finger of the other assembly.

5. The apparatus of claim 1 further characterized in that each finger has a first portion adjacent the respective band portion, a second portion axially more remote from the respective band portion than the first portion and a third portion axially more remote from the respective band portion than the second portion, the maximum circumferential dimension of the second portion being substantially greater than the corresponding maximum circumferential dimension of each of the first and third portions.

6. The apparatus of claim 1 further characterized in that each of the finger assemblies in a planar condition has a first cutout between adjacent fingers of the respective assembly and a generally trapezoidal cutout between said adjacent fingers, the trapezoidal cutout having a minor base opening to the first cutout, and the first cutout being between the trapezoidal cutout and the respective band portion, the first cutout having a substantially larger dimension intermediate the opening thereof to the trapezoidal cutout and the respective band portion than said opening.

7. The apparatus of claim 6 further characterized in that a finger of each assembly extends through the cutouts of the other assembly.

8. The apparatus of claim 6 further characterized in that each spring assembly is an integrally formed, single continuous unit.

9. For receiving a core or a soil sample, a core or soil sample receiving tube having a central axis and an axially inner end and an annular fitting or drill bit mounted on the above axially inner end to in cooperation therewith provide an internal core retainer ring mounting recess and a core retainer, said core retainer including a core retainer ring mounted in said recess, a first spring finger assembly having a first axially inner circumferential band secured to said mounting ring and a plurality of circumferentially spaced first spring fingers having axially inner ends joined to said first band portion and extending axially outwardly thereof and opposite end portions axially remote from the mounting ring, and a second spring finger assembly having a second axially inner circumferential band secured to the first band with the first band extending between the second band and the mounting ring and a plurality of circumferentially spaced second spring fingers having axially inner ends joined to said second band and extending axially outwardly thereof and opposite end portions axially remote from the mounting ring, said fingers being resilient and being arcuately curved to have a datum closed position that the fingers extend axially outwardly and radially toward said central axis to have finger opposite end portions in at least partial axially overlapping relationship closely adjacent said central axis, and being movable against their resilient characteristics to have their outer end portions more axially remote from the mounting ring and more radially remote from the central axis than in their closed position.

10. The apparatus of claim 9 further characterized in that each finger has a first axially extending edge and a second axially extending edge circumferentially spaced from the first axially extending edge, the first axially extending edge of each of the first fingers in the closed position along at least a major portion of the length thereof axially overlapping a major portion of the length of the radially adjacent finger of the second assembly.

11. The apparatus of claim 10 further characterized in that second axially extending edge of each of the first fingers in a closed position along at least a major portion of the length thereof axially underlaps a major portion of the length of the radially adjacent finger of the second assembly, the fingers of the second assembly underlapping and overlapping a major portion of the length of a finger of the first assembly, at their juncture to the second band portion, being circumferentially spaced, circumferential contiguous fingers.

12. The apparatus of claim 11 further characterized in that the first axially extending edge of each of the second fingers in a closed position along at least a major portion of the length thereof axially underlaps a major portion of the length of the radially adjacent finger of the first assembly.

13. For being mounted in the axially inner end portion of a core tube or a soil sampler tube, a core retainer mountable in said tube for retaining core in the tube axially outwardly thereof, said core retainer having a central axis and comprising a mounting ring and spring finger means mounted by the mounting ring for movement between a closed position for retaining core in said tube and an open position extending further axially away from the mounting ring than in the closed position to permit passage of a core therethrough, said spring means including a plurality of elongated fingers having one end portions axially adjacent the mounting ring that are at least partially inteleaved, and opposite end portions that are at least partially interleaved in both the spring means closed positions and the spring open position, said fingers having opposite side edges that diverge from one another in a direction toward the mounting ring.

14. For being mounted in the axially inner end portion of a core tube or a soil sampler tube, a core retainer mountable in said tube for retaining core in the tube axially outwardly thereof, said core retainer having a central axis and comprising a mounting ring and spring finger means mounted by the mounting ring for movement between a closed position for retaining core in said tube and an open position extending further axially away from the mounting ring than in the closed position to permit passage of a core therethrough, said spring means including a plurality of elongated fingers having one end portions axially adjacent the mounting ring that are at least partially interleaved, and opposite end portions that are at least partially interleaved in the spring means closed position, said spring means including a first spring finger assembly and a second spring finger assembly, each of the first and second assemblies respectively including a first plurality and a second plurality of said fingers, the fingers of one assembly being at least partially interleaved with the fingers of the other assembly.

15. For being mounted in the axially inner end portion of a core tube or a soil sampler tube, a core retainer mountable in said tube for retaining core in the tube axially outwardly thereof, said core retainer having a central axis and comprising a mounting ring and spring finger means mounted by the mounting ring for movement between a closed position for retaining core in said tube and an open position extending further axially away from the mounting ring than in the closed position to permit passage of a core therethrough, said spring means including a plurality of elongated fingers having one end portions axially adjacent the mounting ring that are at least partially interleaved, and opposite end portions that are at least partially interleaved in the spring means closed position, said plurality of elongated fingers including a first, a second and a third elongated finger that each has a lower end, the second finger lower end portion being interleaved between the first and third fingers lower end portions and the second finger lower end being of a width that is substantially greater than the spacing between the first and third finger lower ends.

16. For being mounted in the axially inner end portion of a core tube or a soil sampler tube, a core retainer mountable in said tube for retaining core in the tube axially outwardly thereof, said core retainer having a central axis and comprising a mounting ring and spring finger means mounted by the mounting ring for movement between a closed position for retaining core in said tube and an open position extending further axially away from the mounting ring than in the closed position to permit passage of a core therethrough, said spring means including a plurality of elongated fingers having one end portions axially adjacent the mounting ring that are at least partially interleaved, and opposite end portions that are at least partially interleaved in the spring means closed position, said plurality of elongated fingers including a first, a second and a third elongated finger that each has a lower end, the second finger lower end portion being interleaved between the first and third fingers lower end portions and the second finger lower end being of a width that is substantially greater than the spacing between the first and third finger lower ends, the first and third fingers lower portions having adjacent, spaced edge portions, the spacing of said adjacent edge portions being many times less than said width of the second finger lower portion.

* * * * *

UNITED STATES PATENT AND TRADEMARK OFFICE

CERTIFICATE OF CORRECTION

PATENT NO. : 3,952,817

DATED : April 27, 1976

INVENTOR(S) : John Forrest Anderson

It is certified that error appears in the above-identified patent and that said Letters Patent are hereby corrected as shown below:

Column 5, line 6, insert --3/8-- between "portion" and "inch"; delete "inche".

Signed and Sealed this

Thirteenth Day of July 1976

[SEAL]

*Attest:*

RUTH C. MASON
*Attesting Officer*

C. MARSHALL DANN
*Commissioner of Patents and Trademarks*